US009528708B2

(12) United States Patent
Lim et al.

(10) Patent No.: US 9,528,708 B2
(45) Date of Patent: Dec. 27, 2016

(54) COOKING APPLIANCE AND BURNER

(71) Applicant: LG ELECTRONICS INC., Seoul (KR)

(72) Inventors: Jaebeom Lim, Seoul (KR); Janghee Park, Seoul (KR); Yongki Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 261 days.

(21) Appl. No.: 14/285,587

(22) Filed: May 22, 2014

(65) Prior Publication Data

US 2014/0345597 A1 Nov. 27, 2014

(30) Foreign Application Priority Data

May 23, 2013 (KR) ..... 10-2013-0058566

(51) Int. Cl.
*F24C 3/08* (2006.01)
*F23D 14/06* (2006.01)

(52) U.S. Cl.
CPC ..... *F24C 3/08* (2013.01); *F23D 14/06* (2013.01); *F23D 2900/14062* (2013.01)

(58) Field of Classification Search
USPC ..... 126/39 E; 431/354
See application file for complete search history.

(56) References Cited

U.S. PATENT DOCUMENTS

2006/0121402 A1* 6/2006 Bettinzoli ..... F23D 14/06 431/354
2007/0154858 A1 7/2007 Cadima
2011/0056480 A1 3/2011 Dorwarth et al.

FOREIGN PATENT DOCUMENTS

DE 33 46 929 A1 7/1985
EP 0 552 135 A2 7/1993
EP 2 090 826 A1 8/2009
GB 2 223 302 A 4/1990

OTHER PUBLICATIONS

European Search Report dated Feb. 27, 2015 issued in Application No. 14167546.2.

* cited by examiner

*Primary Examiner* — Avinash Savani
(74) *Attorney, Agent, or Firm* — KED & Associates, LLP

(57) ABSTRACT

Provided is a burner. The burner includes a burner body receiving a gas and air, a burner head seated on the burner body, the burner head including an inner burner head and an outer burner head, and a burner cap seated on the burner body to cover the burner head. An outer flame hole through which a mixture gas is discharged and a flame spread space for spreading flame into the inner burner head are defined on the outer burner head, and an inner flame hole through which the mixture gas is discharged and an ignition hole defined under the inner flame hole are defined on the inner burner head.

16 Claims, 5 Drawing Sheets

COOKING APPLIANCE AND BURNER

CROSS-REFERENCE TO RELATED APPLICATIONS

The present application claims priority under 35 U.S.C. 119 and 35 U.S.C. 365 to Korean Patent Application No. 10-2013-0058566 (filed on May 23, 2013), which is hereby incorporated by reference in its entirety.

BACKGROUND

The present disclosure relates to a cooking appliance and a burner.

Cooking appliances are devices that heat a food by using heat supplied from a heating source to cook the food.

The cooking appliances may be classified into gas cooking appliances and electric cooking appliances according to a kind of supplied fuel. Such a gas cooking appliance includes a burner that ignites a supplied gas to heat a food. Such an electric cooking appliance includes a heater or magnetron that generates heat by supplied electricity to heat a food.

The burner may heat a food or a container in which a food is contained. The burner includes a burner body, a burner head, and a burner cap. The burner cap may be seated on an upper portion of the burner head.

Also, in recent years, two burners that are concentrically disposed so that the flames are efficiently utilized and suitably utilized for various cooking containers, i.e., double burners are being widely utilized.

SUMMARY

Embodiments provide a cooking appliance and a burner.

In one embodiment, a burner includes: a burner body to receive a gas and air; a burner head seated on the burner body, the burner head including an inner burner head and an outer burner head; and a burner cap seated on the burner body to cover the burner head, wherein the outer burner head is provided with an outer flame hole through which a mixture gas is discharged and a flame spread space to spread flame into the inner burner head, and the inner burner head is provided with an inner flame hole through which the mixture gas is discharged and an ignition hole disposed under the inner flame hole.

In another embodiment, a burner includes: a burner body to receive a gas and air; a burner head seated on the burner body, the burner head including an inner burner head and an outer burner head; and a burner cap seated on the burner body to cover the burner head, wherein the outer burner head is provided with an outer flame hole through which a mixture gas is discharged and a flame spread space to spread flame into the inner burner head, and the inner burner head is provided with an inner flame hole through which the mixture gas is discharged, an ignition hole to help the ignition of the mixture gas discharged from the inner flame hole, and a rib for to guide the mixture gas discharged from the ignition hole toward the flame spread space.

In further another embodiment, a cooking appliance includes: at least one burner, wherein the at least one burner includes: a burner body to receive a gas and air; a burner head seated on the burner body, the burner head including an inner burner head and an outer burner head; and a burner cap seated on the burner body to cover the burner head, wherein the outer burner head is provided with an outer flame hole through which a mixture gas is discharged and a flame spread space to spread flame into the inner burner head, and the inner burner head is provided with an inner flame hole through which the mixture gas is discharged and an ignition hole defined under the inner flame hole.

The details of one or more embodiments are set forth in the accompanying drawings and the description below. Other features will be apparent from the description and drawings, and from the claims.

DETAILED DESCRIPTION OF THE EMBODIMENTS

Figure 1:
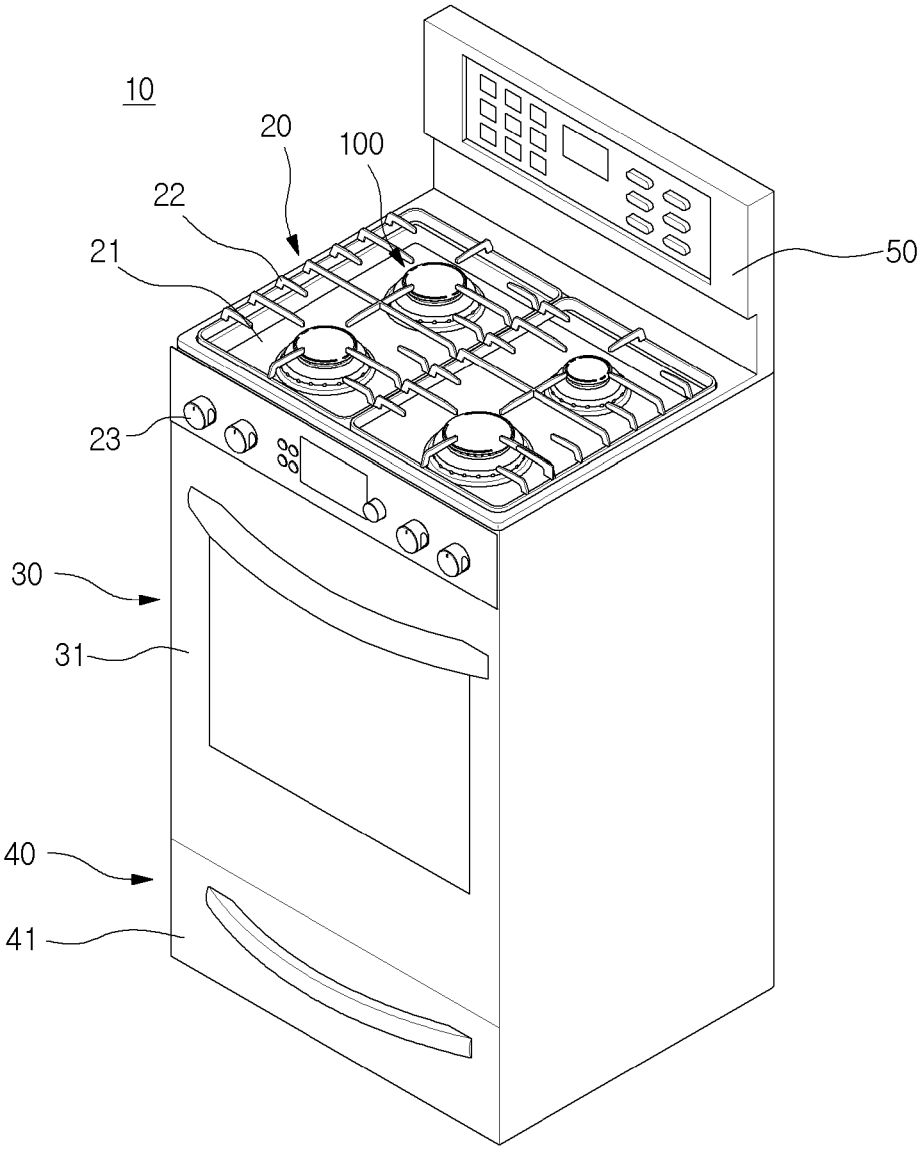
FIG. 1 is a perspective view of a cooking appliance according to an embodiment.

FIG. 1 is a perspective view of a cooking appliance according to an embodiment.

Referring to FIG. 1, a cooking appliance 20 according to an embodiment may include a cook-top unit, an oven unit 30, and a drawer unit 40.

However, according to a kind of cooking appliance, at least one of the oven unit 30 and the drawer unit 40 may be omitted in the cooking appliance 10.

The cooking appliance 10 may further a control unit 50. If the cooking appliance 10 includes only the cook-top unit 20, the control unit 50 may be disposed on the cook-top unit 20.

The cook-top unit 20 may directly heat a food or a cooking container in which a food is contained, which are placed thereon. The cook-top unit 20 may have a top surface that is defined by a top plate 21.

The cook-top unit 20 may include at least one burner 100. The top plate 21 may be provided as a rectangular plate shape having a predetermined thickness. The at least one burner 100 may be mounted on the top plate 21. Here, the burner 100 may pass through the top plate 21 to protrude upward from the top plate 21 to the outside.

Although the cook-top unit 20 includes four burners 100 in FIG. 1, the current embodiment is not limited to the number of burners 100.

The top plate 21 includes an opening having a predetermined sectional area so that at least one portion of the burner 100 is exposed upward. That is, a portion of the burner 100 may be exposed upward through the opening.

Alternatively, the burner 100 may be disposed under the top plate 21 to heat the top plate 21.

The burner 100 may burn a mixture gas, in which a supplied gas and introduced air are mixed with each other, to generate flame for heating a food to be cooked. Here, the food or cooking container may be directly heated to cook the food.

A grate 22 for supporting the cooking container is seated on a top surface of the top plate 21. Substantially, the grate 22 may have predetermined strength and shape to support the cooking container.

The grate 22 may cover the top surface of the top plate on the whole. Alternatively, a plurality of grates 22 may have the same number as that of burner 100. Also, the grate 22 may cover upper portions of the plurality of burners 100 at the same time.

Even though the grate 22 has any shape, the grate 22 may support the cooking container in a state where the cooking container is spaced apart from the burner 100.

At least one manipulation knob 23 to be manipulated by a user to operate the burner 100 may be disposed on a front surface of the cook-top unit 20. The manipulation knob 23 may have the same number as the burner 100. Thus, the user may manipulate the burner 100 by using the manipulation knob 23.

The oven unit 30 may be disposed under the cook-top unit 20, and the drawer unit 40 may be disposed under the oven unit 30.

The oven unit 30 may heat a food after the food to be cooked is placed in an oven chamber (not shown).

The oven unit 30 includes an oven door 31 for selectively opening/closing the oven chamber (not shown).

The oven unit 30 may include at least one heating source for heating the oven chamber. The at least one heating source may include at least one of a broil burner, a baker burner, a convection burner, an electric heater, and a magnetron.

The drawer unit 40 may be configured to warm up a food. The drawer unit 40 may have a space in which a food is accommodated. The drawer unit 40 may include a drawer 41 that is inserted into or withdrawn from the cooking appliance 10.

The drawer 41 may be inserted into the cooking appliance 10 in a state where the cooking container or food is accommodated in an inner space of the drawer 41 to heat the food. Here, a heating source for warming up the cooking container or food may be disposed on the drawer unit 40. Alternatively, the food accommodated in the drawer 4 may warm up by the heating source provided in the oven unit 30.

The control unit 50 may be disposed at a rear end of the cook-up unit 20 to receive an operation state or present state signal of the gas cooking appliance 10, thereby displaying the received signal to inform the state.

The control unit 50 may include an input part for inputting a manipulation command of the oven unit or drawer unit and a display part for displaying various information.

Figure 2:
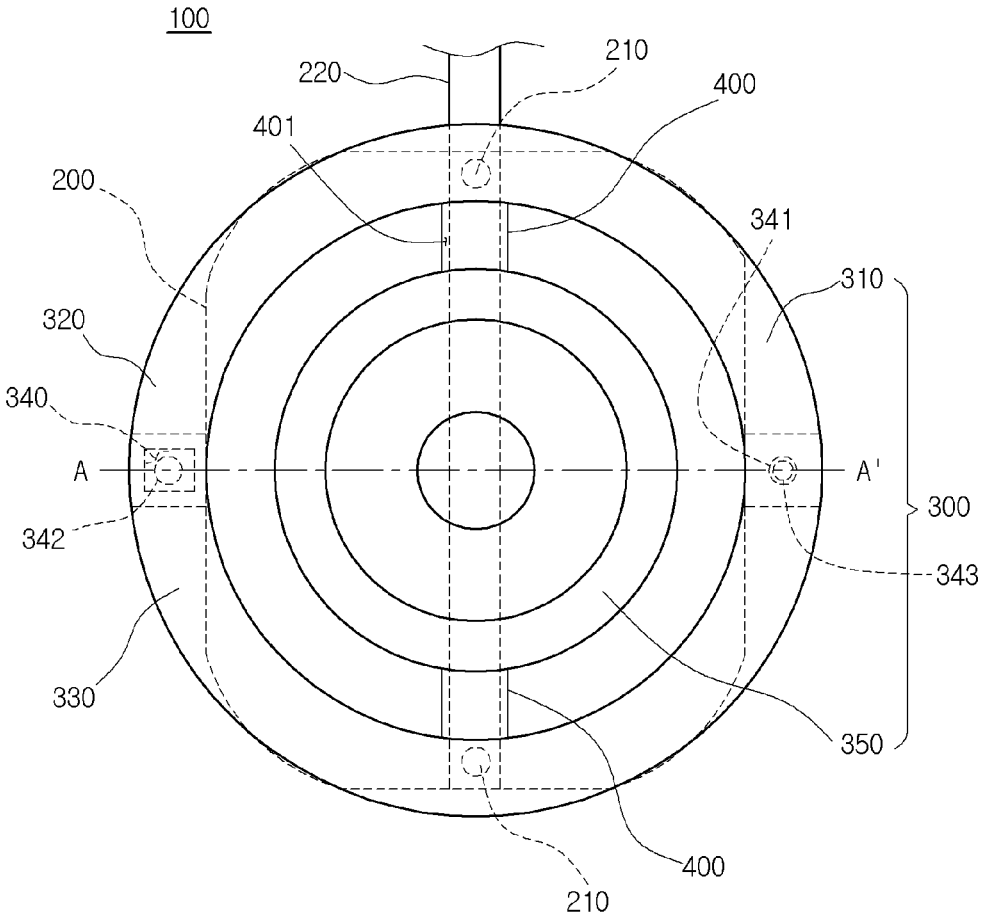
FIG. 2 is a plan view of a burner according to an embodiment.

FIG. 2 is a plan view of a burner according to an embodiment.

FIG. 2 illustrates an example in which the burner cap is removed from the burner.

Referring to FIG. 2, the burner 100 according to the current embodiment may have a double burner structure in which burners 100 are disposed to form a concentric circle on the whole. Alternatively, the burners 100 may be disposed with a double burner structure having a polygonal shape such as a rectangular shape having concentricity except for the concentric circle.

The burner 100 may include a burner body for receiving a gas from the nozzle 210, a burner head disposed above the burner body 200 to ignite the mixture gas of the gas and air, thereby generating flame, and a burner cap 500 seated on an upper portion of the burner head 300 to guide the flame to the outside.

The burner body 200 may be disposed under the top plate 21 and be fixed to a case or fixing part (not shown) provided in an inner space of the cook-top unit 20 or fixed to a bottom surface of the top plate 21.

The burner body 200 may define a space in which a gas sprayed from the nozzle 210 flows. A gas supply tube 220 for guiding introduction of a gas supplied from an external space is disposed under or on a side of the burner body 200. A nozzle 210 for spraying the gas to the burner body 200 may be mounted on the gas supply tube 220.

The gas supply tube 220 may be spaced apart from the burner body 200 or be connected to the gas supply tube 220. When the gas supply tube 220 is spaced apart from the burner body 200, the nozzle 210 may be spaced apart from the burner body 200. In this case, while the gas is sprayed into the burner body 200, surrounding air of the burner body 200 may be introduced into the burner body 200, and thus the air and gas may be mixed with each other within the burner body 200.

When the gas supply tube 220 is connected to the burner body 100, the nozzle 210 may be disposed in a space defined by the burner body 100. In this case, the surrounding air of the burner body 100 may be introduced into the burner body 100 through an air inflow hole defined on the burner body 100 or introduced into the burner body 100 through a gas between the burner body 100 and the burner head 200.

An end of the gas supply tube 220 may be connected to a gas supply device (not shown) for supplying a gas at an external space.

Since the gas supplied from the gas supply device is guided by the gas supply tube 220, the gas may be supplied into the burner body 200 through the nozzle 210.

The mixture gas of the air and gas may flow into an inner space of the burner head 300 disposed on the burner body 200 within the burner body 200.

Here, the burner head 300 may include an outer burner head 310 in which flame is generated on a relatively large area and an inner burner head 350 in which flame is generated on a relatively small area. The inner burner head may be disposed inside the outer burner head 310 and connected to the outer burner head 310 by a connection part 400.

The outer burner head 310 may have the same center as the inner burner head 350.

Alternatively, the outer burner head 310 and the inner burner head 350 may have a polygonal shape having concentricity, but does not have a concentric circle shape.

An inner space of the outer burner header 310 may communicate with the inner space of the burner body 200.

Since the inner space of the external burner head 310 communicates with the inner space of the burner body 200, the mixed air in the inner space of the burner body 200 may flow into the inner space of the external burner head 310.

In FIG. 2, the outer burner head 310 may include a first space 320 and a second space 330. A plug hole 340 mounted on the ignition plug 342 to ignite the mixture gas, thereby generating flame may be defined between the first space 320 and the second space 320. A detection hole 341 on which a detection part 343 for detecting a temperature of the flame generated in the outer burner head 310 is mounted may be defined on a side opposite to the plug hole 340.

Two nozzles 210 for spraying a gas into the burner body 200 may be disposed under the first and second spaces 320 and 330, respectively.

The mixture gas introduced into the outer burner head 310 may be supplied into the inner burner head 350 by the connection part 400.

The connection part 400 may include a connection passage 401 through which the inner space of the outer burner head 310 and the inner space of the inner burner head 350 communicate with each other.

Also, the connection part 400 may be integrated with the outer burner head 310 and the inner burner head 350.

Figure 3:
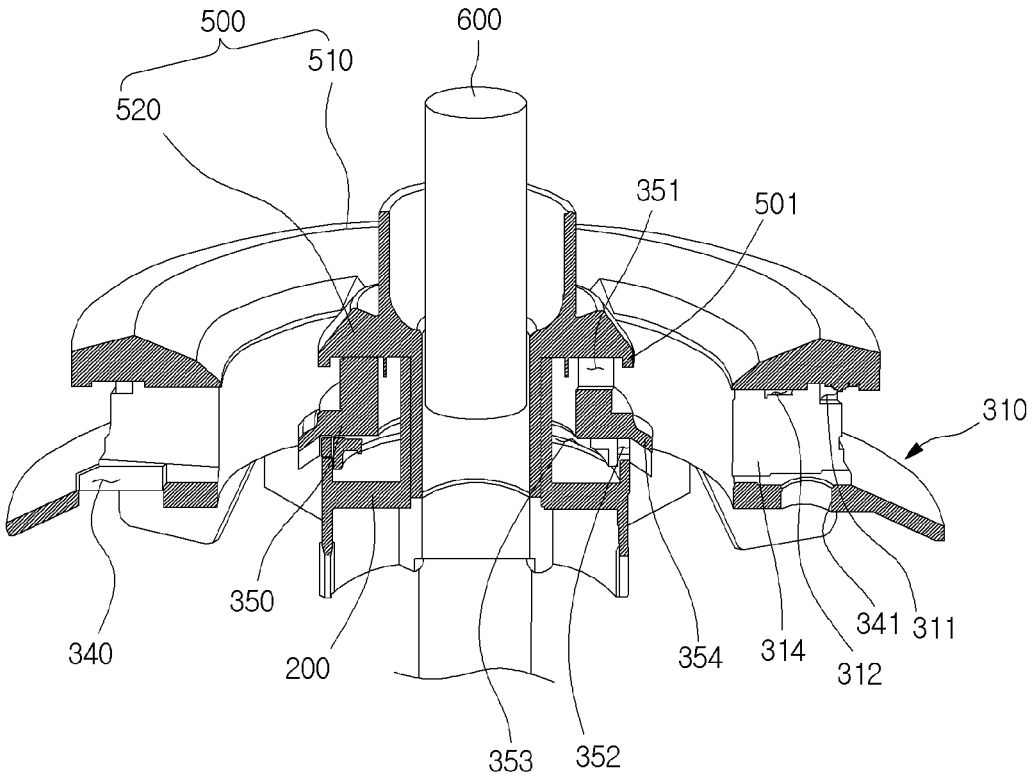
FIG. 3 is a cross-sectional view of the burner according to an embodiment.

When upper sides of the burner head 300 and the connection part 400 are opened, the burner cap (see reference numeral 500 of FIG. 3) is seated on the burner head 300, the opened upper side of the connection part 400 and the opened upper side of the burner head 300 may be covered by the burner cap (see reference numeral 500 of FIG. 3).

FIG. 3 is a cross-sectional view of the burner according to an embodiment.

Referring to FIGS. 2 and 3, the burner cap 500 may be seated on an upper side of the burner head 300 to define an outer appearance of a top surface of the burner 100. The burner cap 500 may include an outer burner cap 510 seated on a top surface of the outer burner head 310 and an inner burner cap 520 seated on a top surface of the inner burner head 350.

The outer burner cap 510 and the inner burner cap 520 may be integrated or manufactured as separate parts. When the outer burner cap 510 and the inner burner cap 520 are manufactured as the separate parts, one of the outer burner cap 510 and the inner burner cap 520 may be seated on the connection part 400 to cover the connection part 400.

The outer burner cap 510 may be seated on the outer burner head 310, and the inner burner cap 52 may be seated on the inner burner head 350.

The outer burner head 310 may have an approximately "U" shape in vertical cross-section.

Also, a predetermined space may be defined in a central portion of the inner burner cap 520, and a sensor 600 may be accommodated in the central space.

The sensor 600 may detect whether the cooking container is disposed above the burner 100. For example, the sensor 600 may be a temperature sensor. That is, when the cooking container is disposed above the burner 100, a temperature detected by the sensor 600 may be lower than that when the cooking container is not disposed above the burner 100. Thus, the temperature detected by the sensor 600 is higher than a preset temperature, the gas supply into the burner 100 may be blocked. That is, when the cooking container is not disposed above the burner 100, the gas supply into the burner 100 may be blocked to prevent a safety accident from occurring.

A plurality of outer flame holes 311 may be defined on the outer burner head 310. The outer flame hole 311 may perform a function as a passage through which the mixture gas flowing into the inner space of the outer burner head 310 is exhausted to an outer space of the outer burner head 310.

That is, the mixture gas flowing into the inner space of the outer burner head 310 may be exhausted to the outer space through the outer flame holes 311, and the exhausted mixture gas may be ignited by the ignition plug 342.

As described above, the flame ignited and generated while the mixture gas is exhausted to the outer space of the outer burner head 310 may be formed along an edge of the outer burner head 310 to heat the cooking container disposed above the burner 100.

Also, a flame spread space 312 for spreading the flame of the outer flame hole 311 to the inner burner head 350 may be defined on the outer burner head 310. Also, the flame spread hole 341 for discharging the mixture gas into the flame spread space 312 may be defined on the outer burner head 310. Thus, the mixture gas discharged from the flame spread hole 341 may be ignited by the flame generated in the outer flame hole 311 to allow flame to exist in the flame spread space.

The flame spread space 314 may be covered by the outer burner cap 350. If the flame generated in the outer burner head 310 is spread to the inner burner head 350, the present disclosure is not limited to a shape of the flame spread space 314.

A plurality of inner flames 351 may be generated in the inner burner head 350.

The mixture gas exhausted through the inner flame hole 351 may be ignited by the flame spread by the flame spread space 312.

At least one ignition hole 352 through which the mixture gas is discharged to ignite the mixture by the flame that is spread by the flame spread space 312 under the inner flame hole 351 may be defined on the inner burner head 350. That is, the ignition hole 352 may help the ignition of the mixture gas discharged from the inner flame hole 351.

The at least one ignition hole 352 may disposed to face the flame spread space 314.

When the mixture gas is exhausted to the outside of the inner burner head 350 through the ignition hole 352, the mixture gas may be ignited by the flame spurted from the flame spread space 312. Thus, the mixture gas exhausted through the inner flame hole 351 may be ignited by the ignited flame. That is, the ignition hole 352 may prevent the ignition failure of the mixture gas discharged from the inner flame hole 352 from occurring.

The inner burner head 350 may have a plurality of holes in a vertical direction by the ignition hole 352 disposed under the inner flame hole 351. Here, the inner flame hole 351 may be called a first hole, and the ignition hole 352 may be called a second hole.

Since the inner flame hole 351 and the ignition hole 352 are defined on the inner burner head 350, even though the flame of the inner burner head 350 is extinguished, flame may be generated again in the inner burner head 350 by the flame spread by the flame spread space 312.

The lowest portion of the inner flame hole 351 may be disposed at a height that is equal to or higher than the highest portion of the flame spread space 314. Also, the highest portion of the ignition hole 352 may be lower than that of the highest portion of the flame spread space 314.

Thus, while the mixture gas discharged through the ignition hole 352 flows upward, the flame spread from the ignition spread space 314 may be ignited by the flame.

That is, the mixture gas exhausted through the ignition hole 352 may be disposed under the flame of the flame spread space 314 to flow upward. Thus, the mixture gas may be ignited by the flame spurted from the flame spread space 314. Also, the mixture gas discharged from the inner flame hole 351 may be ignited by the flame of the ignition hole 352.

Also, a rib 354 for guiding the mixture gas discharged from the ignition hole 352 to flow downward may be disposed on the inner burner head 350. The mixture gas discharged from the ignition hole 352 may flow downward from the rib 354 and then flow upward. Thus, the mixture gas may be stably ignited by the flame spread from the ignition spread space 314.

For another example, when the rib 354 is disposed on the inner burner head 350, the highest portion of the ignition hole 352 may be disposed at a height that is equal to or higher than the highest portion of the flame spread space 314. In this case, the mixture gas discharged from the ignition hole 352 may flow downward toward the flame spread space 314 by the rib 354 and then flow upward. Thus, the mixture gas may be stably ignited by the flame spread from the ignition spread space 314.

The lowest portion of the rib 354 may be lower than the highest portion of the flame spared space 314.

A rib 501 may be disposed on the inner burner cap 521. The rib 501 may guide the mixture gas discharged from the inner flame hole 351 to flow downward.

The mixture gas discharged into a space between the inner burner head 350 and the outer burner head 310 by the ribs 354 and 501 may be reduced in flow rate by an eddy phenomenon or direction change. Thus, an occurrence of a phenomenon in which the flame gets out of an outer edge of the inner burner head 350, i.e., a lifting phenomenon may be prevented.

A portion of the burner body 200 may be inserted into the burner head to form a mixture gas chamber 353. Thus, the mixture gas flowing into the connection part 400 may be supplied into the mixture gas chamber 353 and then be discharged through the inner flame hole 351 and the ignition hole 352. Also, a portion of the inner burner cap 520 may be inserted into the burner body 200.

Hereinafter, an effect of the burner according to an embodiment will be described with reference to FIGS. 4 and 5.

Figure 4:
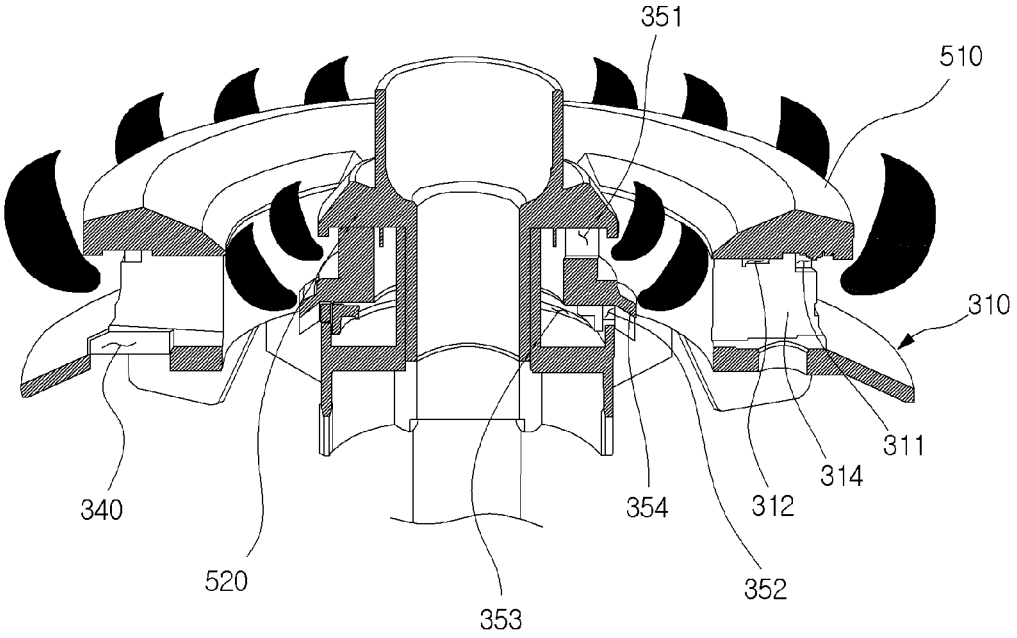
FIG. 4 is a view of a state in which a burner is normally burned according to an embodiment.
Figure 5:
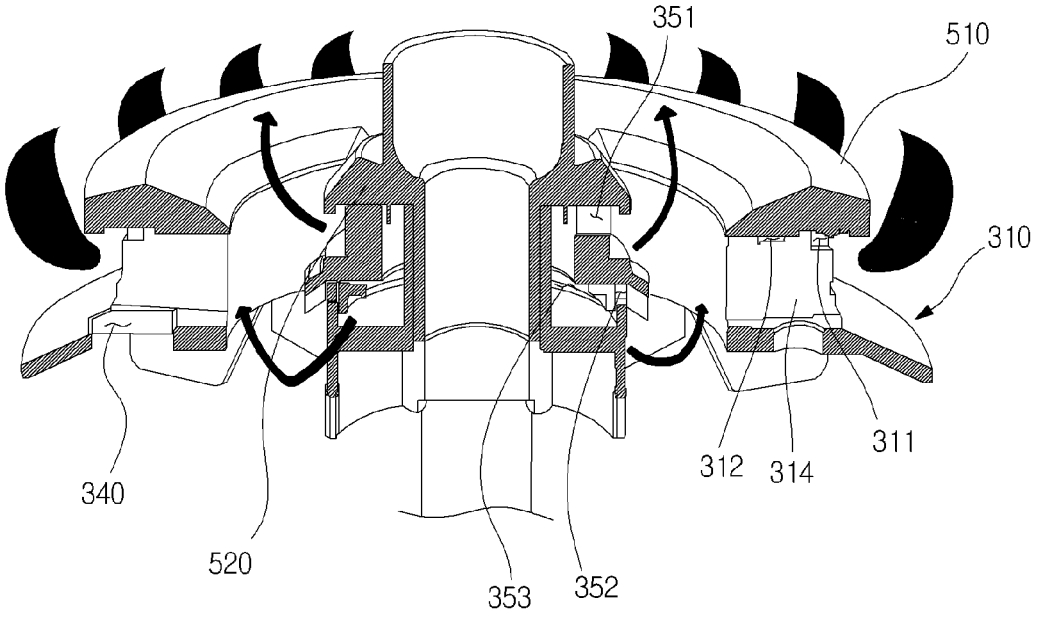
FIG. 5 is a view of a state in which an inner burner head is extinguished in the burner according to an embodiment.

FIG. 4 is a view of a state in which a burner is normally burned according to an embodiment, and FIG. 5 is a view of a state in which an inner burner head is extinguished in the burner according to an embodiment.

Referring to FIGS. 4 and 5, a gas may be sprayed from the nozzle 210 into the inner space of the burner body 200, and air may be introduced into the burner body 200.

The gas and air introduced into the inner space of the burner body 200 may be mixed with each other while flowing.

The mixture gas within the burner body 200 may be supplied into the outer burner head 310 and then discharged through the outer flame hole 311 and flame spread hole 312, which are defined on the outer burner head 310.

A portion of the mixture gas introduced into the inner space of the outer burner head 310 may be supplied into the inner burner head 350 by the connection part. Also, the mixture gas supplied into the inner burner head 350 may be discharged through the inner flame hole 351 and the ignition hole 352.

Here, when the ignition plug mounted on one side of the outer burner head 310 operates, the mixture gas discharged to the outside of the outer burner head 310 may be ignited to generate flame.

Also, the flame generated in the outer burner head 310 may be spread into the flame spread space 314 to ignite the mixture gas discharged from the inner burner head 350.

The flame of the inner burner head 350 may be extinguished according to an effect of external air or a change in external environment.

Here, when the gas supplied into the burner 100 has specific gravity less than that of air, for example, when the gas is methane, the mixture gas discharged from the ignition hole 352 may flow upward and be ignited by the flame of the flame spread space 314. Thus, the mixture gas discharged from the inner flame hole 352 may be ignited by the generated flame.

On the other hand, when the gas supplied into the burner 100 has specific gravity greater than that of air, for example, when the gas is propane, the mixture gas discharged from the ignition hole 351 may flow downward and be ignited by the flame of the flame spread space 314.

That is, according to the current embodiment, the ignition hole 352 is defined under the inner flame hole 351, the mixture gas discharged from the inner burner head 350 may be stably ignited regardless of a kind of gas. Thus, leakage of the gas may be prevented.

In the foregoing embodiment, various modifications may be allowable. Although the outer burner head 310 and the inner burner head 350 are seated on the one burner body 200 in the current embodiment, the present disclosure is not limited thereto. For example, two burner heads 300, i.e., the outer burner head 310 and the inner burner head 350 may be seated on two burner bodies 200, respectively.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner body to receive a gas and air;

a burner head seated on the burner body, the burner head comprising an inner burner head and an outer burner head; and a burner cap seated on the burner body to cover the burner head, wherein the outer burner head includes an outer flame hole through which a mixture gas is discharged and a flame spread space to spread flame into the inner burner head, and the inner burner head includes an inner flame hole through which the mixture gas is discharged and an ignition hole through which the mixture gas in the inner burner head is discharged to ignite the mixture gas by the flame that is spread by the flame spread space, wherein the ignition hole is disposed under the inner flame hole.

2. The burner according to claim 1, wherein a highest portion of the ignition hole is lower than a highest portion of the flame spread space.

3. The burner according to claim 2, wherein a highest portion of the inner flame hole is disposed at a height that is equal to or higher than the highest portion of the flame spread space.

4. The burner according to claim 3, wherein the burner cap comprises:

an inner burner cap to cover the inner burner head; and an outer burner cap to cover the outer burner head, and a rib to guide the mixture gas discharged through the inner flame hole to flow downward, wherein the rib is disposed on the inner burner cap.

5. The burner according to claim 2, wherein a rib to guide the mixture gas discharged from the ignition hole to flow downward is disposed on the inner burner head.

6. The burner according to claim 1, wherein a highest portion of the ignition hole is higher than a highest portion of the flame spread space, and a rib to guide the mixture gas discharged from the ignition hole to flow downward toward the flame spread space is disposed on the inner burner head.

7. The burner according to claim 1, wherein a rib to guide the mixture gas discharged from the ignition hole downwardly is disposed on the inner burner head, and a lowest portion of the rib is lower than a highest portion of the flame spread space.

8. The burner according to claim 1, wherein a flame spread hole to discharge the mixture gas into the flame spared space is included in the outer burner head.

9. The burner according to claim 1, wherein the ignition hole is disposed to face the flame spread space.

10. The burner according to claim 1, wherein the burner cap comprises:

an inner burner cap to cover the inner burner head; and an outer burner cap to cover the outer burner head, and wherein a sensor to detect whether an object is present above the burner is disposed on the outer burner cap.

11. The burner according to claim 10, wherein a portion of the inner burner cap is inserted into the burner body.

12. A burner comprising:

a burner body to receive a gas and air;

a burner head seated on the burner body, the burner head comprising an inner burner head and an outer burner head; and a burner cap seated on the burner body to cover the burner head, wherein the outer burner head includes an outer flame hole through which a mixture gas is discharged and a flame spread space to spread flame into the inner burner head, and the inner burner head includes an inner flame hole through which the mixture gas is discharged, an ignition hole through which the mixture gas in the inner burner head is discharged to ignite the mixture gas by the flame that is spread by the flame spread space, and a rib to guide the mixture gas discharged from the ignition hole toward the flame spread space.

13. The burner according to claim 12, wherein a lowest portion of the rib is lower than a highest portion of the flame spread space.

14. The burner according to claim 12, wherein the ignition hole is disposed to face the flame spread space.

15. The burner according to claim 12, wherein the ignition hole is positioned under the inner flame hole.

16. A cooking appliance comprising:

at least one burner, wherein the at least one burner comprises:

a burner body to receive a gas and air;

a burner head seated on the burner body, the burner head comprising an inner burner head and an outer burner head; and a burner cap seated on the burner body to cover the burner head, wherein the outer burner head includes an outer flame hole through which a mixture gas is discharged and a flame spread space to spread flame into the inner burner head, and the inner burner head includes an inner flame hole through which the mixture gas is discharged and an ignition hole through which the mixture gas in the inner burner head is discharged to ignite the mixture gas by the flame that is spread by the flame spread space, wherein the ignition hole is positioned under the inner flame hole.

* * * * *